US005121834A

United States Patent [19]

Tissembaum

[11] Patent Number: 5,121,834

[45] Date of Patent: Jun. 16, 1992

[54] POCKET CASE

[76] Inventor: Ruben A. Tissembaum, 140 S. Reno St. #126, Los Angeles, Calif. 90057

[21] Appl. No.: 722,173

[22] Filed: Jun. 27, 1991

[51] Int. Cl.[5] ..... A45C 11/32

[52] U.S. Cl. ..... 206/38.1; 206/1.5; 206/472; 206/37.1; 206/806; 220/337; 220/339

[58] Field of Search ..... 206/1.5, 38.1, 235, 206/472, 806, 37.1; 220/337, 339, 306, 4.22

[56] References Cited

U.S. PATENT DOCUMENTS

| | | | |
|---|---|---|---|
| 3,111,152 | 11/1963 | Goessling | 206/38.1 |
| 3,811,563 | 5/1974 | Fox | 220/339 |
| 4,163,496 | 8/1979 | Dogliotti | 220/306 |
| 4,294,558 | 10/1981 | Errichiello | 220/339 |
| 4,360,118 | 11/1982 | Stern | 220/306 |
| 4,380,304 | 4/1983 | Anderson | 220/306 |
| 4,402,423 | 9/1983 | Skowronski et al. | 206/806 |
| 4,452,003 | 6/1984 | Deutsch et al. | 206/806 |
| 4,454,958 | 6/1984 | Juillet et al. | 220/339 |
| 4,549,669 | 10/1985 | Rozporka | 220/306 |
| 4,687,100 | 8/1987 | Kreeger | 220/339 |
| 4,691,638 | 9/1987 | Meyer et al. | 220/306 |
| 4,718,550 | 1/1988 | Johnson | 206/472 |
| 4,741,434 | 5/1988 | Liebman | 206/38.1 |
| 4,753,347 | 1/1988 | Bellante et al. | 206/472 |
| 4,784,264 | 11/1988 | Sykes | 206/472 |
| 4,892,195 | 1/1990 | Slavin et al. | 206/806 |
| 4,951,814 | 8/1990 | Belmont | 206/472 |
| 5,024,323 | 6/1991 | Bolton | 206/472 |

*Primary Examiner*—David T. Fidei
*Attorney, Agent, or Firm*—Erik M. Arnhem

[57] ABSTRACT

A small rectangular box having an integral hinged cover openable for access to the box contents. A flange on the cover fits into a slot in one of the box end walls to secure the cover in its closed position. Extending around the external surface of the box is a thin flexible sheet of transparent plastic material; a business card or photo placed between the sheet and the box cover is visible through the sheet.

1 Claim, 1 Drawing Sheet

POCKET CASE

BACKGROUND AND SUMMARY OF THE INVENTION

This invention relates to a rectangular box having a swingable cover for access to the box contents. In its preferred form the box is a relatively small size construction adapted for placement in a person's pocket or purse. The box can be used to contain small items such as coins, postage stamps, keys or needle and thread. An external key ring attachment tab extends from one wall of the box, such that the box serves as a carrying device for the person's keys. Extending along the external surface of the box is a thin rectangular sheet of flexible transparent plastic material; a business card or small picture can be inserted into the space between the transparent sheet and the box surface.

Small boxes for a generally similar purpose are already known. L. F. Otten U.S. Pat. No. 2,596,716 shows an openable box used to contain two keys. A notch in one wall of the box enables a key chain to extend from within the box through the box wall. Marie Bush U.S. Design Pat. No 198,021 shows a combined key chain and article holder that appears to comprise two hingedly-connected sections. One of the sections forms a hollow tray; the other section supports a mirror. Byok Kim U.S. Design Pat. No. 306,095 shows an ornamental case designed to carry a key ring. The case is openable to display phone numbers and addresses.

The box of the present invention is constructed differently than the devices shown in the noted patents. In its preferred form the box of the present invention comprises a flat plastic panel having two parallel V-shaped grooves that subdivide the panel into a first box end wall, a box bottom wall, and a box cover. A second box end wall and two box side walls extend right angularly from the area of the panel that forms the bottom wall. The V-shaped grooves enable the first box end wall to act as a singable linkage between the box bottom wall and cover. The box structure is formed as a low cost one piece plastic molding.

THE DRAWINGS

DESCRIPTION OF A PREFERRED EMBODIMENT OF THE INVENTION

Figure 1:
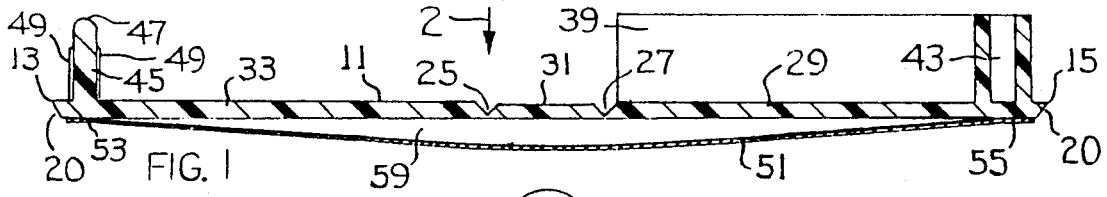
FIG. 1 is a sectional view taken on line 1—1 in FIG. 2, and illustrating one embodiment of the invention.

The drawings show a one piece box that includes a rectangular rigid plastic panel 11 having two end edges 13 and 15, and two side edges 17 and 19. The panel has a longitudinal axis 21 extending parallel to side edges 17 and 19, and a transverse axis 23 extending parallel to end edges—13 and 15. Edges 13, 15, 17 and 19 are bevelled, as shown at 20 in FIGS. 1 and 3; alternatively these edges could have a quarter round cross section.

Figure 3:
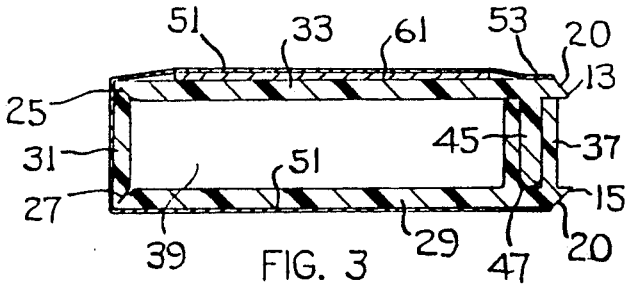
FIG. 3 is a view taken in the same direction as FIG. 1, but showing the box structure folded to a closed condition.
Figure 4:
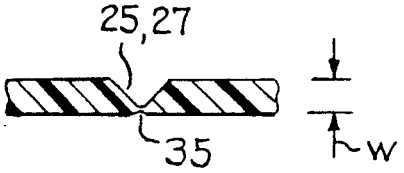
FIG. 4 is a sectional view taken through a grooved portion of a panel used in the FIG. 1 embodiment.

Two V-shaped grooves 25 and 27 are formed in one surface of panel 11 to subdivide the panel into a box bottom wall 29, a first box end wall 31, and a box cover 33. The wall thickness dimension W (FIG. 4) of panel 11 can be about 0.08 inch. The reduced panel thickness at the apex of each groove 25 or 27 will be considerably less than dimension W, e.g. about 0.15 inch. A slight indentation 35 may be formed in the other (lower) face of the panel to facilitate a hinging action between the various panel sections 29, 31 and 33. Each V groove 25 or 27 extends the full transverse dimension of panel 11. As shown in FIG. 3, the various panel sections 29, 31 and 33 can be folded or hinged at the two V grooves so that end wall 31 extends at right angles to bottom wall 29 and cover 33. The cover can be manually swung in a counterclockwise direction around V groove hinge 25 for opening the box.

Figure 2:
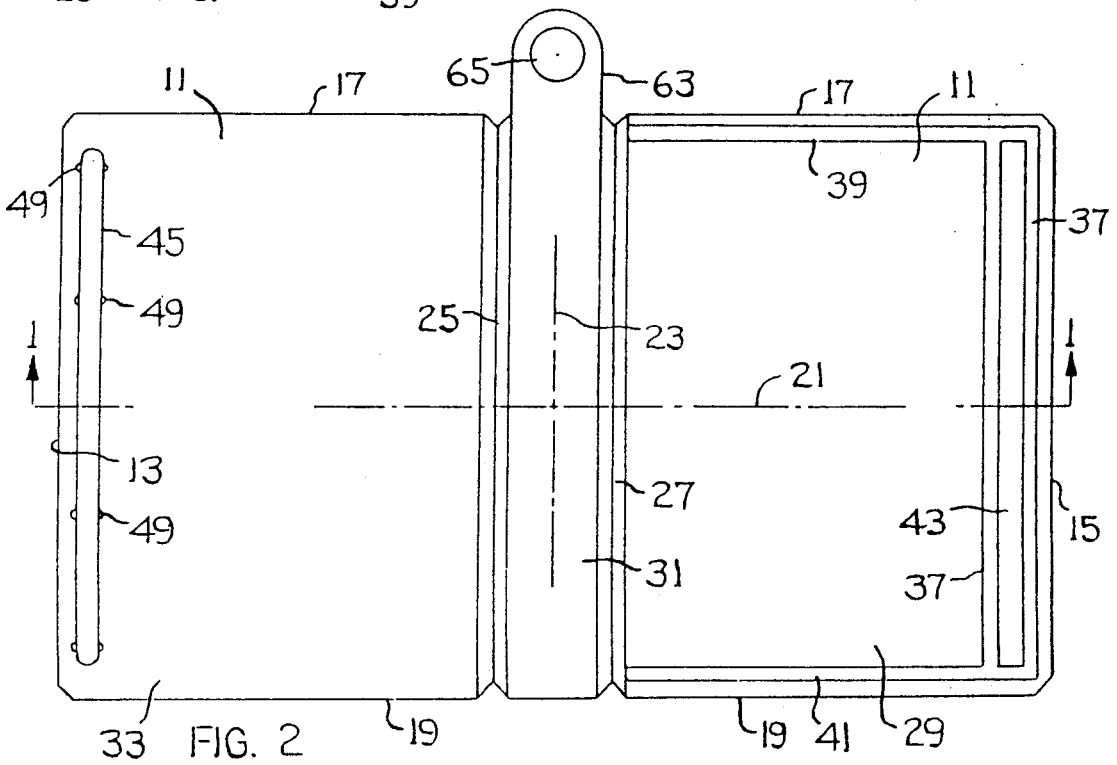
FIG. 2 is as plan view of the FIG. 1 construction taken in the direction indicated by arrow 2.

A second box end wall 37 extends right angularly from panel 11 along edge 15 of the panel. Also, two side walls 39 and 41 extend right angularly from panel 11 along side edges 17 and 19 of the panel. As seen in FIG. 2, walls 37, 39 and 41 are contiguous with each other to form a U-shaped wall structure projecting right angularly from bottom wall 29.

Wall 37 is relatively thick, e.g. about 0.17 inch. A rectangular slot 43 is formed in the wall to receive a flange 45 that extends right angularly from panel 11 at its end edge 13. The leading edge of flange 45 is rounded, at 47, to facilitate entry of the flange into slot 43. Ribs 49 are formed at spaced points along flange 45; when the flange is inserted into slot 43 ribs 49 frictionally engage the slot surface to retain flange 45 in the slot. The slot-flange combination forms a mechanism for retaining cover 33 in a closed position on the box. A person can open the box by gripping edges 13 and 15 with his/her thumbs, and pulling the cover and bottom wall away from each other. To facilitate thumb or finger gripment of the box wall edges the various walls 37, 39 and 41 are inset a slight distance from the associated edges 15, 17 and 19 of panel 11. Typically the amount of the inset is about 0.08 inch.

As shown in FIG. 1, a thin sheet 51 of transparent flexible material is adhesively secured to areas 53 and 55 of panel 11; the intervening portion of sheet 51 (between panel areas 53 and 55) is left unattached.

Sheet 51 is approximately the same thickness as a sheet of paper, e.g. about 0.003 inch thick. Sheet 51 is therefore flexible, such that when the box structure is held in the folded-open condition of FIG. 1, sheet 51 tends to gravitate away from panel 11, leaving a space 59 that can accommodate a small picture or business card 61 (FIG. 3). Sheet 51 extends around the outer surfaces of box walls 29 and 31 and cove 33 to retain card 61 in place on the cover. The pictorial information on card 61 is visible through sheet 51. Sheet 51 has a transverse dimension (parallel to axis 23) only slightly less than the transverse dimension of panel 11.

Referring to FIG. 2, there is shown a tab 63 extending from box end wall 31; the tab is an integral part of panel 11 so that it forms an external extension of box end wall 31. A circular opening 65 is formed through tab 63 to receive a key ring, not shown. Keys, coins, stamps or other items can be contained within the box. The external key ring will have one or more additional keys attached thereto.

The illustrated box is a one piece plastic molding that can be formed at relatively low cost in a one step molding operation. V groove 25 acts as a hinge for the cover. V groove 27 acts as a movable connection between walls 29 and 31, whereby the box can be formed as a relatively simple flat molding, using relatively inexpensive tooling.

What is claimed is:

1. A box adapted for placement in a person's pocket or purse, said box comprising a rectangular plastic panel having two end edges and two side edges; said panel having a longitudinal axis equidistant from its side edges, and a transverse axis equidistant from its end edges; two V-shaped grooves in one surface of the panel parallel to the transverse axis and equidistant therefrom; said parallel grooves subdividing the panel into a first box end wall, a box bottom wall, and a box cover; second box end wall extending right angularly from said panel along one of the panel end edges; and two box side walls extending right angularly from said panel along the panel side edges; said side walls and said second end wall being contiguous so as to form a rigid U-shaped wall structure extending right angularly from the box bottom wall; said V-shaped grooves and said first box end wall forming a swingable linkage between the box bottom wall and the cover, whereby the cover can be swung away from the bottom wall for opening the box; said second box end wall having a single slot (43) extending therealong for a transverse distance only slightly less than the length of the second end wall in the transverse dimension; a single flange (45) extending right angularly from said panel along its other end edge; said flange having a length in the transverse dimension only slightly less than the transverse length of said slot; said flange having a thickness slightly less than the slot thickness, whereby the flange can fit into the slot to hold the cover in a closed position; a plural number of ribs (49) formed on said flange; each rib extending normal to the cover for frictional retentive engagement against the slot surfaces; said U-shaped wall structure being integral with said box bottom wall, and said flange being integral with said cover; a rectangular sheet of transparent flexible material extending along on external face of said plastic panel; said transparent flexible sheet having end edges thereof adhesively secured solely to areas of the panel bordering the panel end edges, with other edges of the sheet being detached from the panel whereby the zone between the end edges of the flexible sheet can be separated from the plastic panel for insertion of a card or paper between the sheet and panel; said flexible sheet having a thickness, where the sheet has appreciable flexibility while the panel is relatively rigid; and a tab (63) extending from said first end wall; said tab having a circular opening therethrough adapted to receive a key ring; said tab being integral with said first end wall.

* * * * *